United States Patent [19]

Rex

[11] Patent Number: 4,801,084

[45] Date of Patent: Jan. 31, 1989

[54] BASE PLATE INSERT

[76] Inventor: Albert E. Rex, 205 Churchill Road, Prospect, Australia, 5082

[21] Appl. No.: 177,874

[22] Filed: Mar. 25, 1988

Related U.S. Application Data

[63] Continuation of Ser. No. 898,345, Aug. 20, 1986, abandoned.

[30] Foreign Application Priority Data

Aug. 21, 1985 [AU] Australia ..... PH2071
Aug. 21, 1985 [AU] Australia ..... 61721/86

[51] Int. Cl.[4] ..... E01B 9/34
[52] U.S. Cl. ..... 238/351; 238/349
[58] Field of Search ..... 238/310, 338, 341, 349, 238/351

[56] References Cited

U.S. PATENT DOCUMENTS 2,294,736 9/1942 Burkhardt ..... 238/349
2,333,518 11/1943 Burkhardt ..... 238/349
4,466,569 8/1984 Taylor ..... 238/310
4,566,631 1/1986 Brown ..... 238/349
4,600,145 7/1986 Geddes ..... 238/351
4,705,215 11/1987 Eisenberg et al. ..... 238/349

FOREIGN PATENT DOCUMENTS 8200669 3/1982 PCT Int'l Appl. ..... 238/351
413653 7/1934 United Kingdom ..... 238/351

*Primary Examiner*—Robert B. Reeves
*Assistant Examiner*—Donald T. Hajec
*Attorney, Agent, or Firm*—Fitch, Even, Tabin & Flannery

[57] ABSTRACT

An insert for a resilient rail fastening system, including a shank terminating at its lower end with an abutment to engage a lower surface of a base plate supporting a rail, the shank having at its upper end downwardly facing clip engaging surfaces which engage a resilient clip so as to cause compression thereof so that the rail engaged by the clip is biased into engagement with the base plate.

9 Claims, 5 Drawing Sheets

BASE PLATE INSERT

This application is a continuation of application Ser. No. 898,345 filed Aug. 20, 1986 now abandoned.

This invention relates to an insert which can be used in conjunction with a base plate for the retention of a resilient rail retaining clip, which clip retains in position rails upon which railway vehicles pass.

There is frequent use of base plates for supporting rails from sleepers, the base plates performing the function of holding gauge over a predetermined area, and usually the rail foot and base plates of a rail are retained by dog spikes which are driven through apertures in the base plates, the dog spikes having heads thereon which engage over the rail foot.

One of the problems which is encountered in track maintenance of a railroad track is that the dog spikes, particularly those directly engaging the rail, eventually work loose from a sleeper (particularly a timber sleeper) and this allows both the base plate and the rail to have movement with respect to the supporting sleeper.

There is considerable demand for resilient fastening systems which employ resilient clips to secure the rail to the base plate. The above-described conventional dog spike systems are not resilient, in that they do not allow movement between the dog spike and the rail. These conventional systems are not adapted to employ resilient clips and accordingly conversion to a resilient fastening system is expensive.

The closest prior art which is known to the applicant is the U.S. Pat. No. 2,333,518, wherein there is disclosed a threaded stud having a leg with a toe which was capable of gripping below the undersurface of a base plate, and a heel which, upon tilting of the leg, would bear against the upper surface. However, such an arrangement is not suited for use in conjunction with the U-shaped type bifurcate clip, firstly since the use of a nut on the end of a threaded stud is unreliable due to the possibility of the nut slackening with the effluxion of time, secondly the threads can and frequently do rust and lose much of their strength, and thirdly, no provision is made or can readily be made for restraint of the stud against tilting as a U-shaped clip is driven into position. Still further, if a spiral spring is used as shown in that specification, the amount of force exerted by the spring in inhibiting tilting is relatively small since the spring will compress on one side but release on the other, and if for any reason a rail foot moves away from the fastener, tilting is liable to occur.

One particular resilient fastening system employes a T-shaped stud to hold in position a resilient clip which biases the rail into contact with the base plate. The T-shaped stud is welded to the base plate. This previously known system has several disadvantage including the cost of installation of the studs and the weakening of the supporting area of the base plate resulting from the welding process.

It is the object of the present invention to overcome or substantially ameliorate the above disadvantages.

There is disclosed herein an insert for a rail fastening system employing a base plate to secure a rail to a sleeper by means of a resilient clip, said insert having an elongated shank to extend below the base plate, an upper end to engage said clip and to retain said clip in a compressed state to bias said rail into engagement with said base plate, and a lower end to be positioned below the plate, which lower end is provided with an abutment surface to engage the plate to prevent withdrawal of the insert by forces applied thereto by said clip; and wherein said upper end has a downwardly facing clip engaging surface which permits installation of the clip in a direction transverse of said shank.

A preferred form of the present invention will now be described by way of example with reference to the accompanying drawings, wherein.

Figure 1:
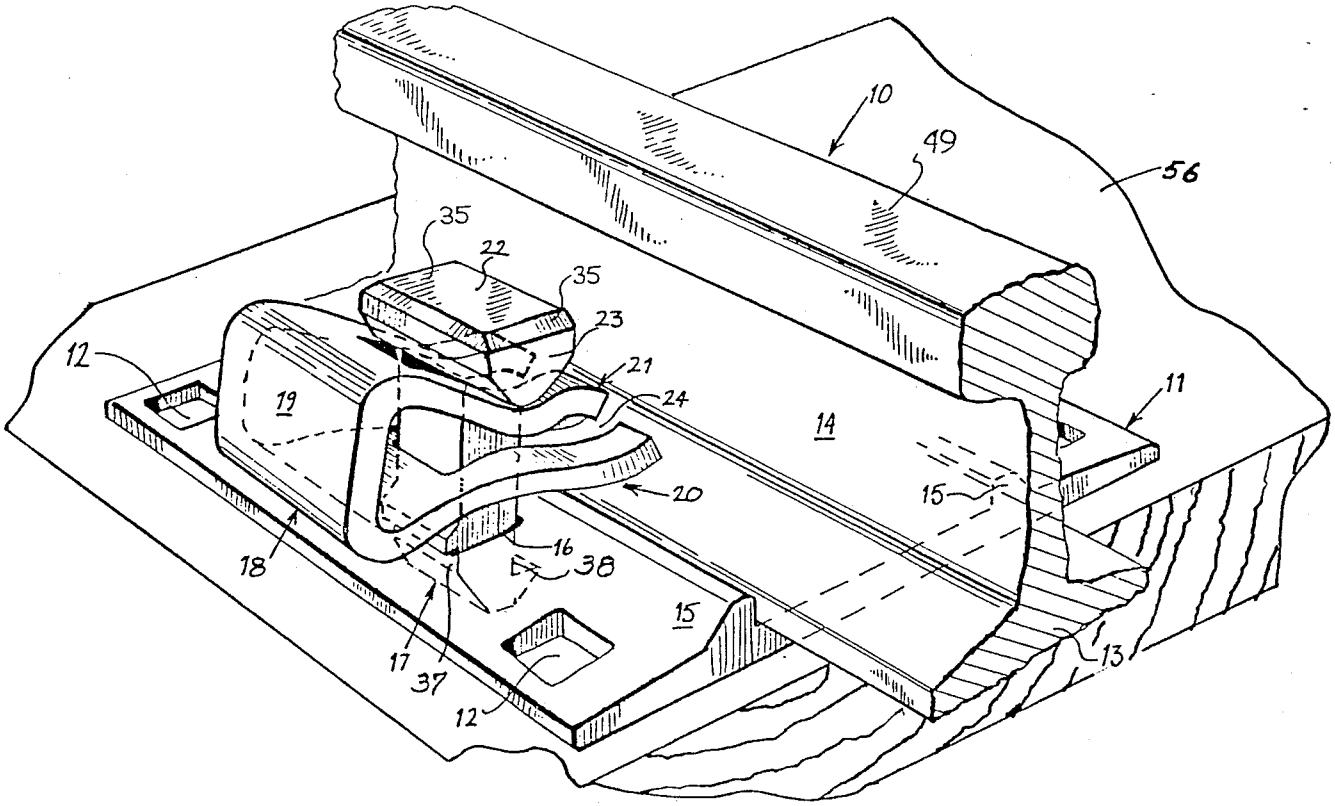
FIG. 1 is a schematic perspective view of a resilient rail fastening system securing a rail to a base plate.
Figure 2:
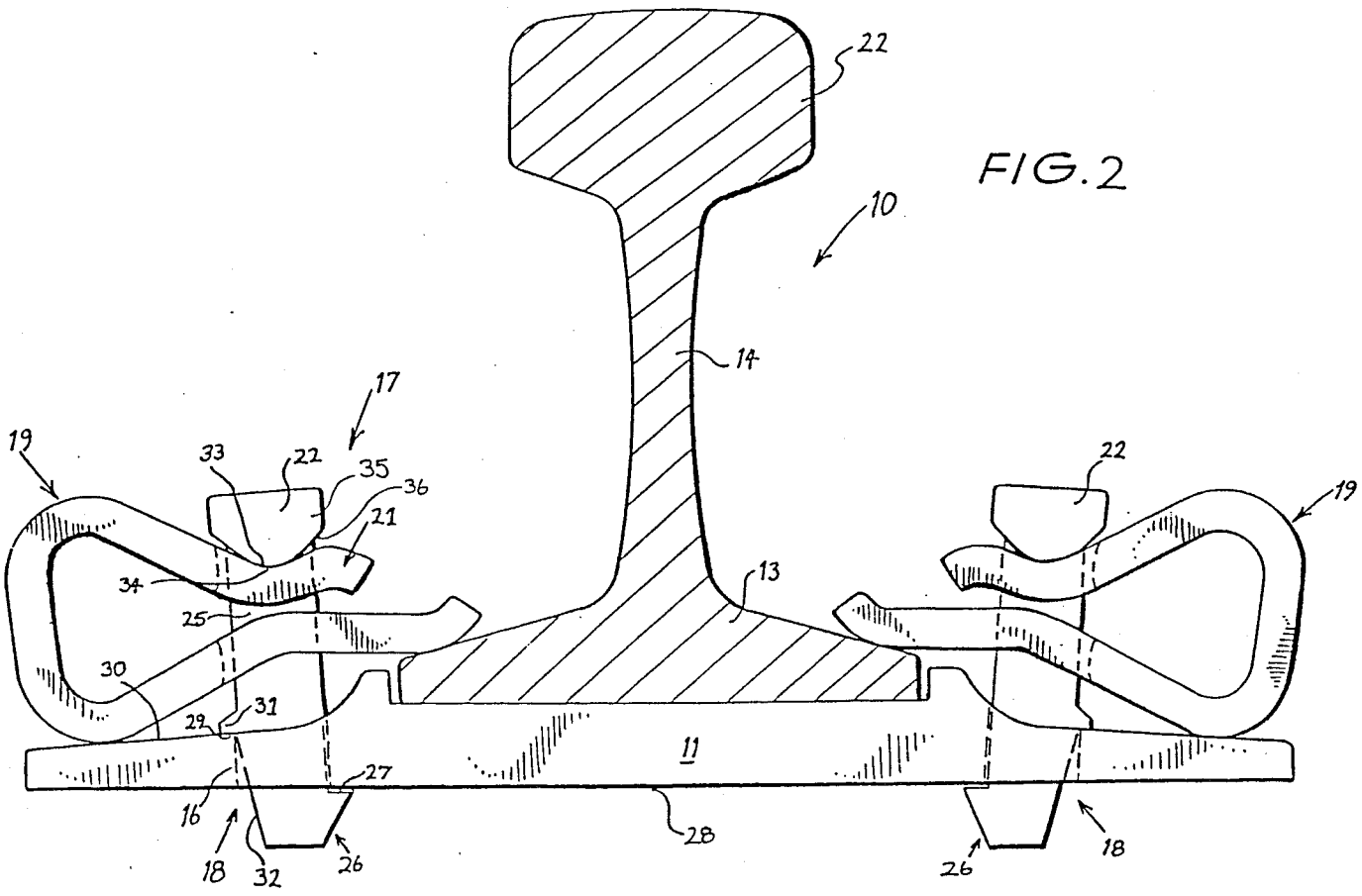
FIG. 2 is a schematic sectioned side elevation of the system rail and base plate.

In FIGS. 1 and 2 there is schematically depicted a rail 10 to engage the wheels of a railway vehicle. The rail 10 is supported on a base plate 11 fixed to a sleeper 56. Conventionally, the base plate 11 is supported on timber sleepers by means of "dog spikes". The dog spikes pass through apertures 12 formed in the base plate 11. The rail 10 has a head 49 joined to a foot 13 by a web 14. The foot 13 is directly mounted on the base plate 11 and is held laterally in position by two ribs 15 which extend longitudinally of the rail 10. The base plate 11 is also provided with an aperture 16 through which an insert 17 passes and which in use is upright compared to the plate 11. The insert 17 is part of a resilient track fastening system employing a clip 18. The clip 18 is of a known construction and is of a generally U-shaped configuration providing a base 19 from which there projects two sets of legs 20 and 21. The legs 20 abut the head 22 of the insert 17, while the legs 20 abut the foot 13 of the rail 10. The head 22 is positioned relative to the foot 13 so that the clip 18 is in a compressed condition thereby biassing the foot 13 into engagement with the base plate 11. More particularly, as the clip 18 is inserted, the legs 20 and 21 are deflected towards each other to thereby resiliently deform the clip 18. The legs 21 are separated by means of a groove 23 to allow the legs 21 to pass the insert 17, similarly the legs 20 are provided with a groove 24.

As best seen in FIG. 2, the insert 17, as mentioned previously, includes a head 22 which engages the legs 21. The head 22 is of a T-shaped configuration so as to provide two horizontally extending arms 35 which are located between the surface 29 and the rail 10 when viewed in plan. The arms 35 extend generally parallel to the rail 10 and provide downwardly facing surfaces 36 which engage the clip 18. The insert basically consists of a shank 25 having an upper end providing the head 22, and a lower end 26 which is located beneath the plate 11. The lower end 26 provides an abutment surface 27 which engages the lower surface 28 of the plate 11. The abutment surface 27, which is basically a step in the shank 25, prevents the insert 17 from being withdrawn due to forces being applied thereto by the clip 18. The shank 25 is also provided with a further abutment surface 29 which engages the upper surface 30 of the plate 11. The abutment surface 29 prevents backward tilting of the insert 17. The abutment surface 29 is provided by a step 31 against which an impact force may be applied to aid in insertion of the insert 17. the abutment surface 29 also defines the operative position of the insert 17, in combination with the abutment surface 27. The insert 17 has a cross-section adjacent the surface 29 which is approximately the cross-section of the aperture 16 as best seen in FIG. 2. As seen in FIG. 1, a vertical surface 37 abuts the internal surface of the aperture 16 as does the vertical surface 38. The surfaces 37 and 38 aid in retaining the insert 17 upright as discussed previously, by engaging the vertical forward and vertical rear surfaces of the aperture 16.

The rear face of the lower end 26 of the shank 25 is provided with a relief surface 32 so as to taper the lower end 26 of the insert. This arrangement enables the lower end 26 of the shank to be inserted through the aperture 16. When inserting the insert 17, the longitudinal axis of the insert must be inclined to the horizontal. For example, the end 26 could be designed so that upon the longitudinal axis of the shank 25 being inclined at about 20° to the vertical, the lower end 26 will pass through the aperture 16 enabling the abutment surface 27 to be engaged with the lower surface 28 of the base plate 11. It may be necessary when inserting the insert 17, to apply an impact force against the shoulder 31.

The clip 18 is retained in its operative position by the apex 33 of the head 22 being located within a concave portion 34 provided by each of the legs 21. Accordingly, any lateral movement of the rail 10 will not cause movement of the clip 18 relative to the insert 17. As the clip 18 also engages the base plate 11, the clip 18 aids in inhibiting rail creep, that is, movement of the rail along its longitudinal direction of extension, by frictionally engaging both the base plate 11 and the rail 10.

It may be advantageous to prevent movement of the head 22 towards the rail 10 during insertion of the clip 18, by locating an anvil between the head 22 and the web 14. Accordingly, as the clip 18 is inserted in a direction transverse of the shank 25, the head 22 will not be tilted towards the rail 10.

Figure 8:
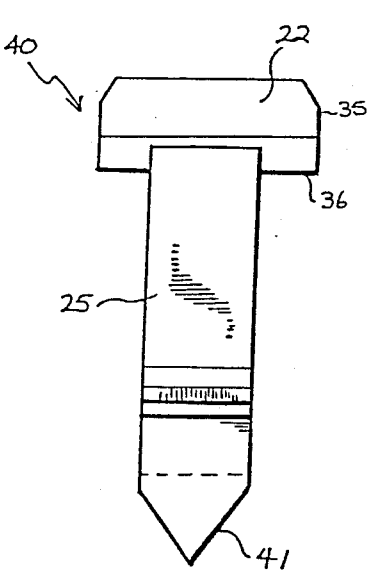
FIGS. 6 to 8 are schematic elevations of a still further alternative insert to be employed in the resilient fastening system of FIG. 1.
Figure 7:
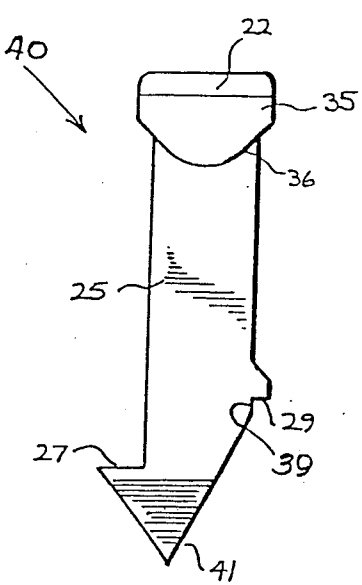
Figure 6:
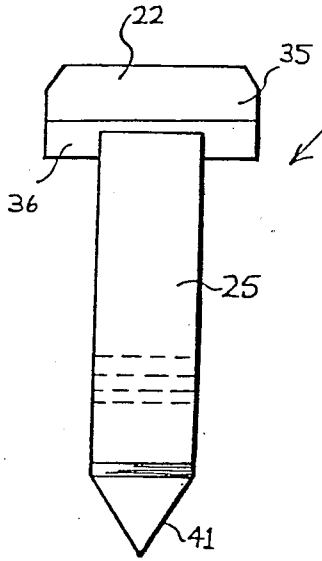

In FIGS. 6 to 8 there is schematically depicted an insert 40 which may be used as a replacement for the insert 17 of FIGS. 1 and 2. Basically, the insert 17 of FIGS. 1 and 2 is designed to be employed where a dog spike aperture has been previously formed in the timber sleeper. The insert 40 of FIGS. 6 to 8 is provided with a pointed lower end 41 enabling the lower end 41 to penetrate a "soft timber" sleeper. Accordingly, the sleeper need not be provided with a dog spike aperture. The insert 40 has features in common with the insert 17, which common features appearing in the insert 40 having been given the same numerals as the features of the insert 17.

Figure 5:
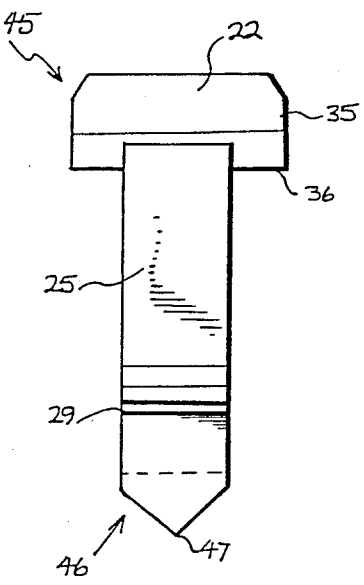
FIGS. 3 to 5 are schematic elevations of an alternative insert to be employed in the resilient fastening system of FIG. 1.
Figure 4:
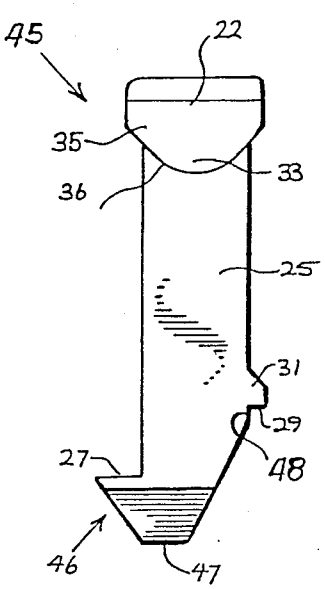
Figure 3:
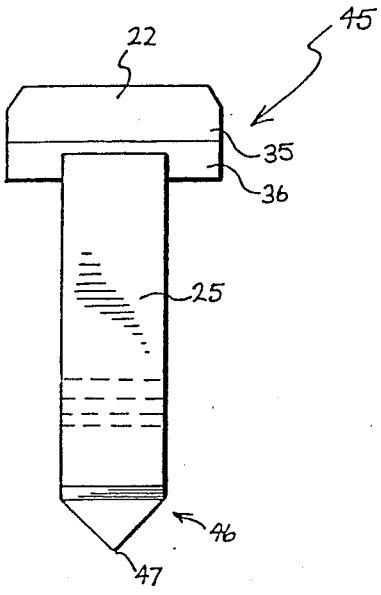

FIGS. 3 to 5 illustrate a further insert 45 with the lower end 46 thereof being tapered so as to provide a "chisel" edge 47 to replace the point 41 of the insert 40. The chisel edge 47 is provided to enable the insert 45 to be used in instances where the sleeper is not provided with a dog spike aperture.

Figure 9:
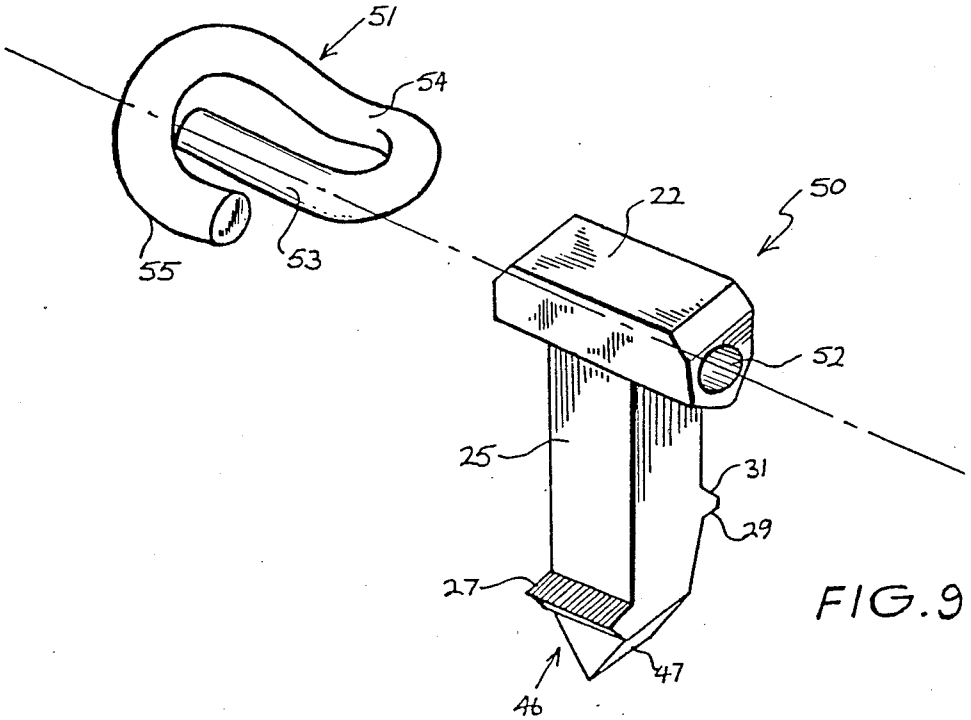
FIG. 9 is a schematic parts exploded perspective view of an alternative insert and alternative clip to be used in the resilient fastening system of FIG. 1.

In FIG. 9 there is schematically depicted an insert 50 and clip 51 of a resilient fastening system which may be used as an alternative to the fastening system of FIGS. 1 and 2. In this particular embodiment, the insert 50 is similar in construction to the insert 45 in that it is provided with a chisel edge 47. However, the head 22 is provided with a transverse passage 52 to receive a straight section 53 of the clip 51. The clip 51 has a rail foot engaging portion 54 and a base plate engaging portion 55. In use, when the clip 51 is applied to the insert 50, the straight section 53 passes through the passage 52, and the portions 54 and 55 engage the rail foot and base plate respectively. In this position, the clip 51 is resiliently deformed in order to bias the rail into contact with the base plate. The clip 51 is of a known construction and is sold under the Trade Mark "Pandrol". It should be appreciated that the clip 51 is inserted in the passage 52 by moving the clip 51 in a direction transverse of the shank 25.

With the above-described preferred embodiments of the present invention, existing dog spike arrangements may be replaced with a resilient fastening system. For example, a dog spike can be removed and replaced with one of the above-described inserts and the appropriate clip used. The insert is positioned by inclining the shank and then driving the insert outwardly until the abutment surface 27 is engaged beneath the base plate, and the abutment surface 29 engaged on top of the base plate. The appropriate clip 18 or 51 can then be inserted and an anvil used if necessary.

As best seen in FIGS. 4 and 7, the inserts 45 and 40 have vertical surfaces 48 and 39 respectively to abut the internal surfaces of the aperture 16, as seen previously in respect of FIGS. 1 and 2. Referring to FIG. 1, the vertical surfaces 37 and 38 abut internal surfaces of the base plate aperture 16 to secure engagement of the insert 17 to the base plate 11. The insert securely engages against the base plate internal surfaces so as to be oriented relatively normal to the base plate when inserted in the aperture thereof.

What I claim is:

1. An insert for a rail fastening system employing a base plate having generally vertical internal surfaces defining an aperture through which the insert passes, to secure a rail having a head to a timber sleeper by means of a resilient clip, said insert having an elongated shank to extend below the base plate, an upper end to engage said clip and to retain said clip in a compressed state to bias said rail into engagement with said base plate, and a lower end to be positioned below the plate, which lower end is provided with a tip for penetrating the timber sleeper and a lower abutment surface to engage the plate to prevent withdrawal of the insert by forces applied thereto by said clip; said upper end having a downwardly facing clip engaging surface which permits installation of the clip in a direction transverse of said shank, the shank having a front surface adjacent the rail and a rear opposed surface, and wherein said insert has a relief surface so as to taper the lower end of the insert, the relief surface being on the rear opposed surface of said shank behind said lower abutment surface enabling insertion of the shank into said aperture by tilting of the insert, said shank further having a generally transverse base plate-engaging surface above said relief surface such that said insert securely engages against said base plate internal surfaces so as to be oriented relatively normal to the base plate when inserted in said aperture thereof.

2. The insert of claim 1 wherein the tip of the lower end is pointed.

3. The insert of claim 1 wherein the tip of the lower end includes a chisel edge.

4. The insert of claim 1, wherein said upper end is of a T-shape configuration so as to provide two horizontally extending arms, extending generally transverse of said shank and which, in use, are generally parallel to said rail head, said arms providing said clip engaging surface.

5. The insert of claim 4, wherein said lower abutment surface, in use, is located between said arms and said rail when viewed in plan.

6. The insert of claim 5, including an upper further abutment surface which, in use, is located further from said rail relative to said lower abutment surface, when viewed in plan, which further abutment surface engages an upper surface of said base plate.

7. The insert of claim 6, wherein said insert upper end is provided with a passage extending generally transverse of said shank so that, in use, said passage extends generally parallel to said rail, said passage being dimensioned to receive a portion of said clip and to provide said downwardly facing clip engaging surface.

8. The insert of claim 6, wherein said shank has a transverse horizontal cross-section, adjacently below said upper abutment, which is approximately equal to a transverse cross-section of said aperture.

9. The insert of claim 6, wherein said aperture has a forward and a rearward generally vertical surface, and said shank has a vertical surface to engage said forward surface, and a generally planar portion extending downward from said upper abutment surface, which engages the rearward surface of said aperture.

* * * * *